US007394036B2

(12) United States Patent
Aartsen

(10) Patent No.: US 7,394,036 B2
(45) Date of Patent: Jul. 1, 2008

(54) LATCHING MECHANISM

(75) Inventor: Frank A. Aartsen, Mijnsheerenland (NL)

(73) Assignee: EJA, Limited, Wigan (GB)

( * ) Notice: Subject to any disclaimer, the term of this patent is extended or adjusted under 35 U.S.C. 154(b) by 46 days.

(21) Appl. No.: 11/071,911

(22) Filed: Mar. 4, 2005

(65) Prior Publication Data

US 2005/0285411 A1 Dec. 29, 2005

(30) Foreign Application Priority Data

Mar. 6, 2004 (GB) ..... 0405163.7

(51) Int. Cl.
*H01H 13/00* (2006.01)
*H01H 13/14* (2006.01)
*H01H 9/20* (2006.01)

(52) U.S. Cl. ..... 200/334; 200/43.04

(58) Field of Classification Search ..... 200/334
See application file for complete search history.

(56) References Cited

U.S. PATENT DOCUMENTS 3,532,374 A 10/1970 Holscher
4,101,750 A * 7/1978 Doner ..... 219/724
5,595,286 A * 1/1997 Schulze ..... 200/335
5,777,284 A * 7/1998 Mohtasham ..... 200/43.04
6,982,391 B2 * 1/2006 Da Dalt ..... 200/43.04

* cited by examiner

*Primary Examiner*—Lincoln Donovan
*Assistant Examiner*—Lheiren Mae A. Anglo
(74) *Attorney, Agent, or Firm*—Quarles & Brady LLP; William R. Walbrun

(57) ABSTRACT

A radial latching mechanism for engaging a safety switch is described. The radial latching mechanism includes an actuator holder, and an actuator for engaging the safety switch, attached to the actuator holder in a predetermined orientation relative to the holder. The mechanism has a body for supporting the actuator holder, and a first radial member extending between and pivotally connected by respective pivot points to both the body and the actuator holder. The radial latching mechanism further includes a second radial member extending between and pivotally connected by respective pivot points to both the body and the actuator holder. Each pivot point has a pivot axis, all of the pivot axes being substantially parallel.

17 Claims, 4 Drawing Sheets

LATCHING MECHANISM

TECHNICAL FIELD

The present invention relates to latching mechanisms, and in particular but not exclusively, latching mechanisms for safety switch assemblies used in machinery guards enclosing kinetic machinery.

DESCRIPTION OF THE BACKGROUND ART

Known safety switch assemblies comprise a safety switch adapted to be fitted to an enclosure, and an actuator attached to a latching mechanism adapted to be fitted to a door, gate or protective cover of the enclosure. The actuator is insertable into the safety switch to turn on the electrical power supply when the enclosure is closed by the door, gate or protective cover.

Radial latching mechanisms for engaging safety switches are well known in the art. Such latching mechanisms include an actuator mounted on a pivotal member, thus allowing the actuator to be rotated in a plane defined by the pivot axis of the member. This rotational movement moves the actuator into and out of the safety switch.

U.S. Pat. No. 5,595,286 describes an improved radial latching mechanism, in which the actuator is pivotally mounted upon the pivotal member such that the actuator may be rotated about an axis perpendicular to the plane of the pivoting circle of the latching mechanism as the pivotal member is moved to an open or a closed position. This arrangement allows not only pivoting of the actuator about the pivot access, but also tilting relative to the pivot plane. As a result, tolerances arising in various parts during assembly of the safety switch and its latching mechanism can be compensated for.

However, the design is complex. Further, adjustment of the latching mechanism via setscrews within the mechanism are required to arrange for the actuator to be in the appropriate insertion position and insertion angle for the actuator to be received by the safety switch. Due to the limited range of movement provided by the design, problems can arise if, for instance, during the lifetime of the safety switch assembly, the door to which the latching mechanism is attached is moved relative to the enclosure to which the safety switch is attached e.g. if the door drops.

It is an aim of embodiments of the present invention to provide an improved radial latching mechanism that substantially addresses one or more of the problems of the prior art, whether referred to herein or otherwise.

SUMMARY OF THE INVENTION

According to a first aspect, the present invention provides a radial latching mechanism for engaging a safety switch, the radial latching mechanism comprising an actuator holder, an actuator for engaging the safety switch, attached to the actuator holder in a predetermined orientation relative to said holder, a body for supporting the actuator holder, a first radial member extending between and pivotally connected by respective pivot points to both the body and the actuator holder and wherein the radial latching mechanism further comprises a second radial member extending between and pivotally connected by respective pivot points to both the body and the actuator holder and each pivot point has a pivot axis, all of said pivot axes being substantially parallel.

By providing two such radial members, the orientation of the actuator holder (and hence the actuator) can be controlled as the radial latching mechanism is moved between an open and a closed position. Thus, the latching mechanism can be arranged such that the actuator will still be correctly orientated to engage the safety switch, even if a door on which the latching mechanism is mounted drops. Further, this control of the orientation of the actuator is provided by a mechanically simple device.

The distance between the pivot points of the first radial member may be substantially equal to the distance between the pivot points of the second radial member.

The distance between the pivot point connecting the first radial member to the body and the pivot point connecting the second radial member to the body may be substantially equal to the distance between the pivot point connecting the first radial member to the actuator holder and the pivot point connecting the second radial member to the actuator holder.

Both said first radial member and said second radial member may be substantially planar, and extend in a common plane substantially perpendicular to said pivot axes.

The actuator may be resiliently biased so as to maintain said predetermined orientation.

The actuator may extend from said actuator holder along a first axis, and is arranged to tilt away from said first axis.

The first axis may extend in an actuator plane substantially perpendicular to said pivot axes, said actuator may be arranged to tilt in at least one of said actuator plane and a plane substantially perpendicular to said actuator plane.

The latching mechanism may further comprise a guide unit fixedly located on said actuator holder, extending in a substantially parallel direction to said predetermined orientation of the actuator, and arranged to mate with a corresponding guide unit on a safety switch.

The guide unit may be a wedge-shaped member.

The latching mechanism may further comprise a safety switch, said safety switch being arranged to be actuated upon being engaged by said actuator.

According to a second aspect, the present invention provides an enclosure comprising a frame and a door, one of the door and the frame having a safety switch attached thereto, and the other of the door and the frame having a radial latching mechanism attached thereto for engaging said safety switch, the radial latching mechanism comprising an actuator holder, an actuator for engaging the safety switch, attached to the actuator holder in a predetermined orientation relative to said holder; a body for supporting the actuator holder, a first radial member extending between and pivotally connected by respective pivot points to both the body and the actuator holder and wherein the radial latching mechanism further comprises a second radial member extending between and pivotally connected by respective pivot points to both the body and the actuator holder and each pivot point has a pivot axis, all of said pivot axes being substantially parallel.

The latching mechanism may comprise a first release handle extending outside of the enclosure, and a second release handle extending inside of said enclosure, the release handles being operable to disengage the actuator from the safety switch.

According to a third aspect, the present invention provides a method of manufacturing a radial latching mechanism for engaging a safety switch, the method comprising providing an actuator holder attaching to the actuator holder, in a predetermined orientation relative to said holder, an actuator for engaging the safety switch, providing a body, pivotally connecting a first end of a first radial member to the body by a respective pivotal point, and pivotally connecting a second end of the first radial member to the actuator holder by a respective pivot point, pivotally connecting a first end of a second radial member to the body by a respective pivotal point, and pivotally connecting a second end of the second radial member to the actuator holder by a respective pivot point, each pivot point having a respective pivot axis, with the first and second radial members being arranged such that all of the pivot axes are substantially parallel.

BRIEF DESCRIPTION OF THE DRAWINGS

Embodiments of the present invention will now be described, by way of example, with reference to the accompanying drawings, in which.

DESCRIPTION OF THE PREFERRED EMBODIMENT

Figure 1:
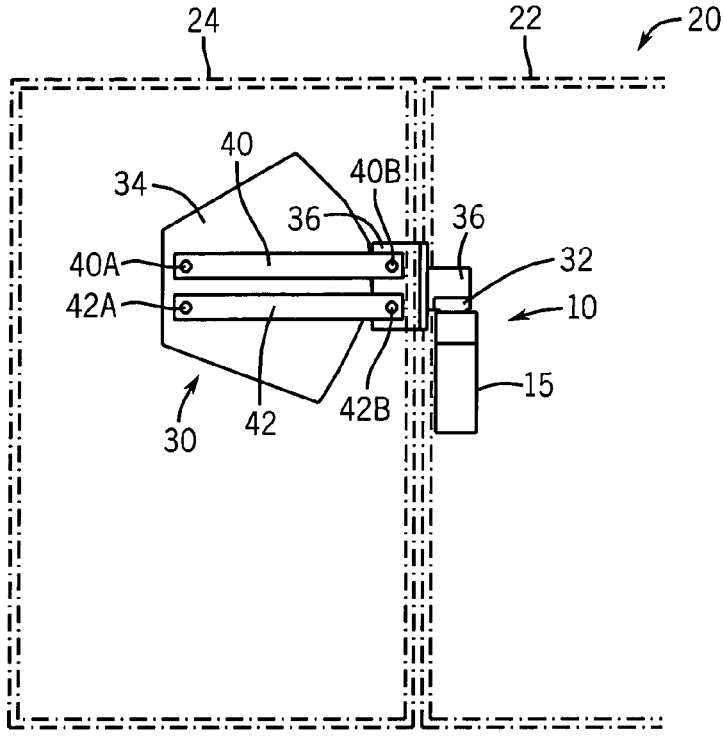
FIG. 1 illustrates a first embodiment of the present invention in a closed position, with the radial latching mechanism attached to a door and aligned relative to the safety switch.
Figure 2:
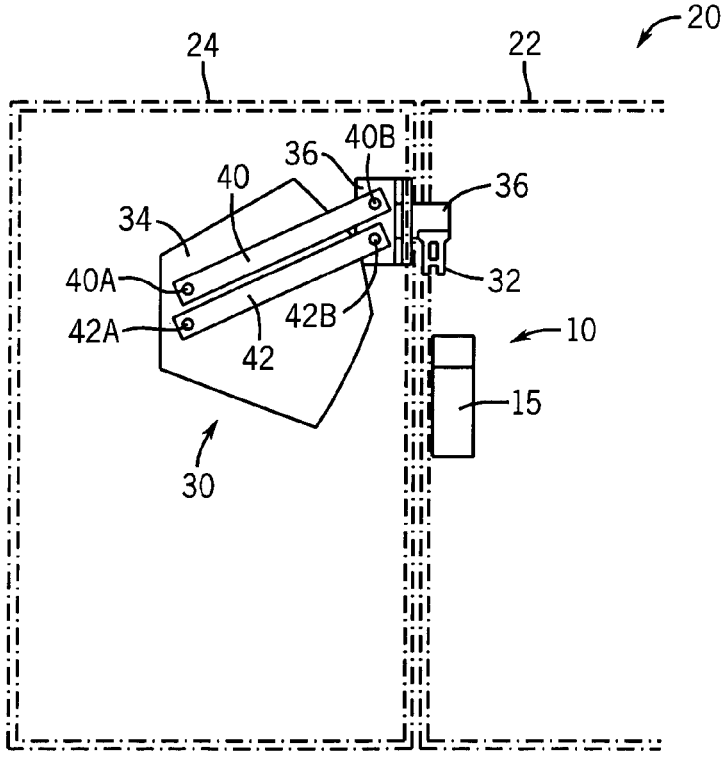
FIG. 2 illustrates the first embodiment in an open position, with the radial latching mechanism aligned relative to the safety switch.

FIGS. 1 and 2 show a side view of a safety latch assembly 10 connected to an enclosure 20 in respectively a closed and an open position. The enclosure 20 comprises a frame 22, which at least in part defines an aperture. The frame 22 may, for instance, be a section of a wall of a cage. A door 24 is arranged to fit into the aperture when in the closed position.

The enclosure 20 acts to enclose a kinetic machine e.g. a lathe. The safety latch assembly 10 is provided to ensure that the lathe will only operate when the door is in the closed position.

The safety latch assembly comprises a safety switch 15 and a radial latching mechanism 30. The latching mechanism 30 comprises an actuator 32.

An electrical power supply is connected to the safety switch 15. The radial latching mechanism is arranged to allow the actuator 32 to be inserted into, and removed from cooperation with the safety switch 15. Typically, the latching mechanism 30 is located on the door, whilst the safety switch 15 is located on an adjacent portion of the enclosure, such that the actuator 32 may only engage the safety switch 15 when the door 24 is closed. The actuator 32 operationally cooperates with the safety switch, so as to turn on the electrical power supply when the enclosure is closed by the door 24.

The latching mechanism 30 comprises a body 34 pivotally coupled to an actuator holder 36. The actuator 32 is arranged to extend in a predetermined orientation relative to the actuator holder 36. The preferred actuator is resiliently biased to maintain this orientation and is conveniently referred to as fully flexible. The construction thereof is well known in the art and is not described further hereinafter. However, in the alternative a safety switch that allows the actuator to move inside its actuated position, e.g. sideways and radially would also suffice.

The actuator holder 36 is coupled to the body 34 by two members 40, 42. The members 40, 42 are herein referred to as radial members, as they define an arc in a plane through which the actuator holder 36 moves relative to the body 34. At a first end, each of the members 40, 42 is pivotally connected to the body 34 by a respective pivot point 40A, 42A e.g. by an axle. The other end of each member 40, 42 is pivotally connected at a pivot point 40B, 42B to the actuator holder 36. The radial members 40, 42 are substantially planar, and extend in a plane substantially perpendicular to the pivotal axes of the pivot points 40A, 40B, 42A, 42B.

In this particular embodiment, the members 40, 42 are of equal length, with the distance between the pivot points along each member being substantially the same. Further, the members are substantially parallel, with the spacing between the pivot point 40A connecting the first radial member 40 to the body and the pivot point 42A connecting the second radial member 42 to the body being substantially the same as the spacing between the other two pivot points 40B, 42B.

The relative distance between the pivot points on each member, and the spacing between the corresponding pivot point on the adjacent member defines the movement path of the actuator holder 36 relative to the body 34, as well as the orientation of the actuator holder 36 as the radial members 40, 42 are moved.

In this particular instance, due to the spacing and distances between the pivot points, although the actuator holder 36 will follow the path of an arc relative to the body 34, the actuator holder will maintain a predetermined orientation relative to this body. As the actuator 32 is attached to the actuator holder 36 in a predetermined orientation, then equally the actuator 32 will maintain a predetermined orientation relative to the body 34. The orientation of the actuator referred to herein is the direction along the actuator in which the actuator body can engage the safety switch 15.

In this particular instance, in the sense shown in the Figures, the actuator is arranged to extend along a vertical axis. The actuator will maintain this orientation along a vertical axis as the actuator holder follows the path of an arc relative to the body. This orientation is the orientation in which the actuator 32 of this embodiment can engage the safety switch 15 (when the actuator 32 is at the correct height). This control of the orientation of the actuator is an advantage over the prior art radial latch mechanism, in which the actuator normally maintains a predetermined orientation relative to the radial member (also termed the pivotal member) i.e. the orientation of the actuator will vary relative to that of the body 34.

Figure 3:
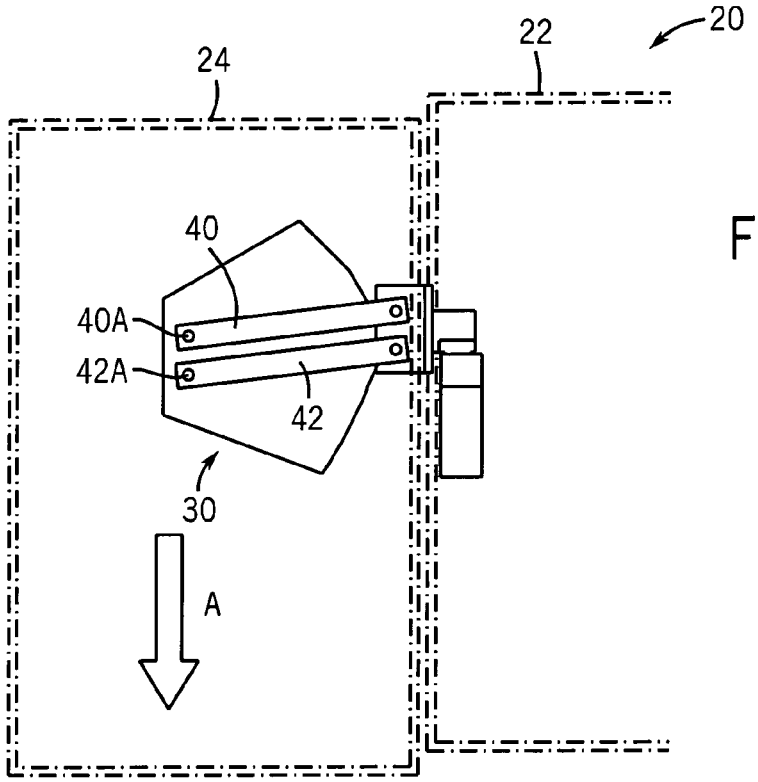
FIG. 3 illustrates the first embodiment in a closed position, with the radial latching mechanism misaligned due to the door having dropped.

The particular advantage of this will be apparent from studying FIG. 3, which shows the same apparatus illustrated in FIGS. 1 and 2. In FIG. 3, the door 24 has dropped, relative to the frame 22, in the direction illustrated by arrow A. Typically, such a movement would prevent a prior art actuator from engaging the safety switch 15, due to the actuator being maintained in an incorrect alignment.

Figure 4:
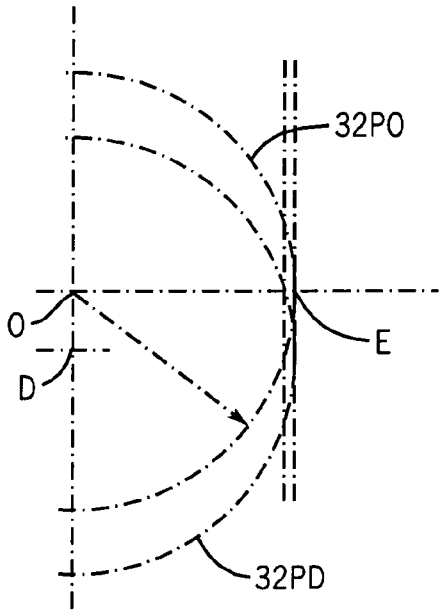
FIG. 4 illustrates the geometrical range of movement of the radial latching mechanism of the first embodiment.

FIG. 4 shows the geometrical arrangement of the radial latching mechanism 30. If point O is taken as the mid point position between the two pivot points 40A 42A, then it will be appreciated that the actuator 32 will follow the path 32PO i.e. an arc of radius R. The point E shows the position at which the actuator 32 would normally engage the safety switch 15.

Figure 5:
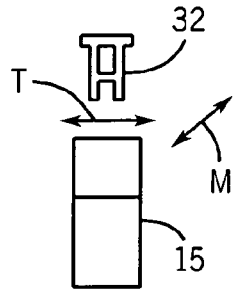
FIG. 5 illustrates the resilient biasing of the actuator of the first embodiment.

When the door drops, the latching mechanism, which is fixed to the door will also drop with point O moving to new position D. The actuator 32 will now follow path 32 PD. The safety switch 15, which is fixed to the frame 22 will not move, such that the position E (i.e. the desired engagement point) remain fixed. However, due to the predetermined orientation of the actuator 32, the actuator 32 will still engage the safety switch 15 as it travels along path 32PD past position E. This engagement is facilitated by the actuator being arranged to move transversely (in the direction shown by arrow T in FIG. 5) i.e. slide along an axis substantially perpendicular to the axis along which the actuator extends. If the actuator is regarded as moving within a rotational plane (the "pivot plane") as the latching mechanism operates, then this transverse axis is also within the pivot plane. The actuator 32 is resiliently biased however to maintain the central position within the transverse movement range. Preferably, the movement range is at least 5 mm.

Preferably, the actuator 32 is also arranged to move (e.g. pivot) in a direction perpendicular to the pivot plane, as illustrated by the arrows M. Preferably, this range of movements is at least 5 mm. Preferably, the actuator 32 is again resiliently biased, to maintain the central position.

Consequently, by providing two members with pivot points as described above, the radial latch mechanism 30 is able to compensate for misalignment of the door.

Figure 6:
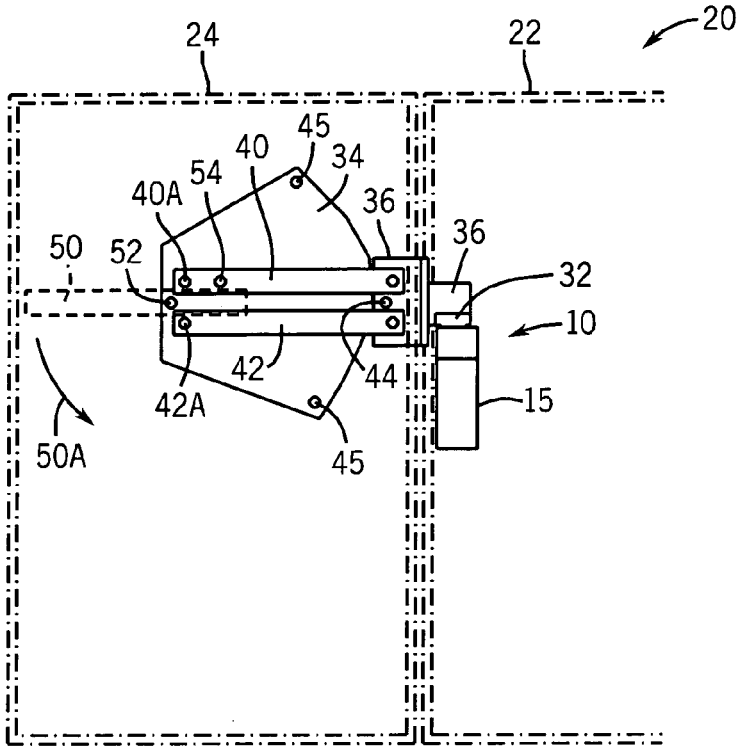
FIG. 6 illustrates a first embodiment of the present invention, with the optional movement apparatus attached.

It will be appreciated that the above embodiments are provided by way of example only, and that various alternatives will be apparent to the skilled person as falling within the scope of the present invention. For instance, FIG. 6 shows an embodiment of the present invention fitted with optional movement features. A handle 44 is fixedly connected to the actuator holder 36. The handle 44 may extend into, or out of the enclosure 20. By moving (lifting) the handle 44, the actuator 32 will disengage from the safety switch 15. The handle 44 may be ball-shaped, to allow it to be easily grasped by a human hand.

The latching mechanism may also be operated by handle 50, formed as a lever. The lever 50 pivots about pivot point 52, connected to body 34. One of the radial members 40, 42 has a member extending perpendicular to the plane of the member. When the lever 50 is pushed in the direction indicated by the arrow 50A, the distant end of the lever 50 will engage the member 54, thus causing the radial member 40 to move upwards, with the actuator 32 disengaging from the safety switch 15.

Preferably, at least one of the aforesaid handles 44, 50 is located within the enclosure 20, to act as an emergency release.

Although the above embodiments have been described with reference to a right hand door, it will be appreciated that the embodiments can also be used for left hand doors, sliding doors and double doors. Misalignment within the tolerances provided by the sideways movement of the actuator and the rotational movement of the radial members does not affect the emergency release function.

Embodiments may additionally utilise a guiding means. Typically, it is envisaged that a male guiding means will be located on the radial latching mechanism, whilst a corresponding female guiding means will be located on the safety switch 15. The guiding means is provided so that, as the actuator holder is moved through the arcuate path defined by the radial members 40, 42, and prior to the actuator engaging the safety switch, the guide means on the actuator holder will first engage the corresponding guide means on the safety switch. Subsequently the movement will then act such that the guide means act to pull the actuator and the corresponding insertion slot for the actuator on the safety switch into the correct alignment.

Additionally, stops 45 are mounted on the body 34, to limit the arcuate range of movement of the actuator holder to a predetermined angle of arc e.g. 90° (±45° from the nominal horizontal shown in the FIGS.).

Figure 7:
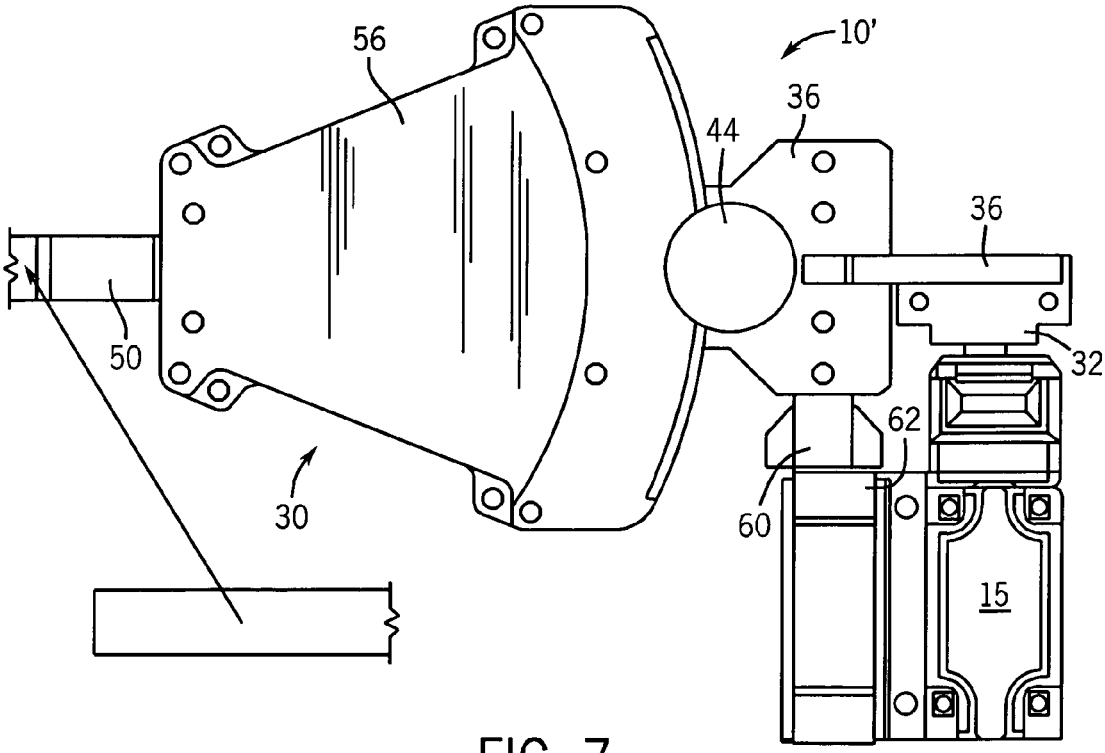
FIG. 7 illustrates a safety latch assembly in accordance with a second embodiment of the present invention.

FIG. 7 shows yet another embodiment of the present invention. The embodiment is generally similar to that shown in FIG. 6 i.e. it has two handles 44, 50. The handle 50 can be used for opening the latch mechanism, whilst the handle 44 can be used both for opening and closing the latch mechanism. In this particular embodiment, the radial latching mechanism 30 is provided with a cover 56, to protect the radial members and respective pivot points from interference.

This embodiment utilises a guiding means in the form of guide unit 60, fixedly located on the actuator holder 36. Preferably, the guide unit 60 is wedge shaped (with the narrowest point of the wedge being at a distance from the actuator holder), arranged to engage a suitable aperture or slot 62 within the safety switch 15. The guide unit extends in a direction substantially parallel to the orientation of the actuator 32. However, the guide unit is arranged to engage a corresponding guide means in the form of slot 62 on the safety switch 15, prior to the actuator 32 engaging the safety switch 15. Consequently, the guide unit 60 will act to pull into position the actuator 32 so as to correctly engage the safety switch 15, even if the actuator is slightly misaligned.

Figure 8:
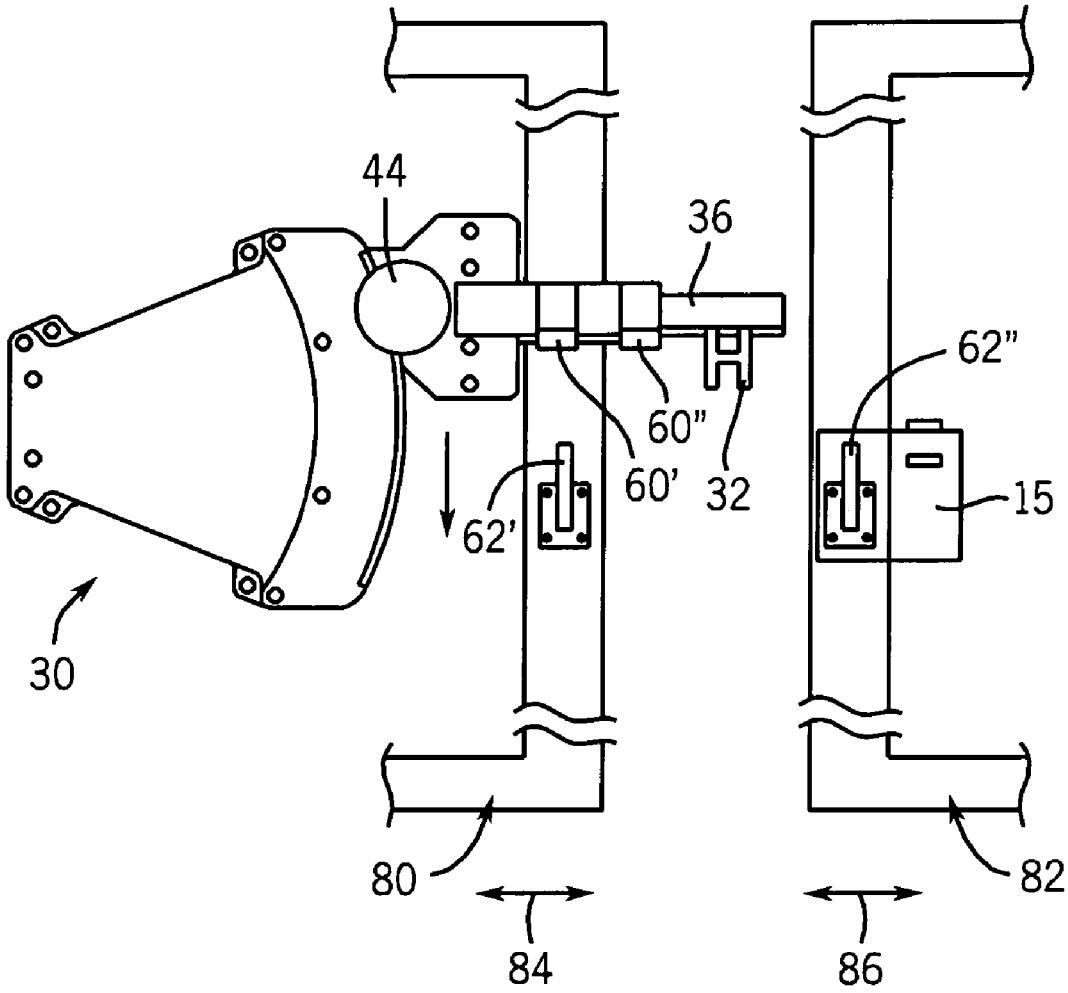
FIG. 8 illustrates a safety latch assembly including two guides.

It will be understood that the radial latching mechanism is usually secured to a door of an enclosure and the safety switch to the frame of the enclosure. Exceptionally they may be the other way round. In the case of an enclosure comprising double doors, be they sliding or hinged, the radial latching mechanism is usually connected to one of the doors and the safety switch is usually connected to the other of the doors. In such a case the latching mechanism may be provided with two guides for co-operating engagement with a respective guide reception member, one of which is attached to the same door as the latching mechanism and the other is attached to the same door as the safety switch. An example of this is described and illustrated with reference to FIG. 8 in relation to a pair of sliding doors. The radial latching mechanism 30 is constructed substantially as previously described and corresponding reference numerals have been used to denote corresponding parts. It is provided with a cover in the manner of the embodiment of FIG. 7 and has an actuating handle 44. The actuator holder 36 comprises and extended arm which carries the actuator 32 and two spaced guide units 60', 60". The guide units 60', 60" are arranged to engage respective guide members 62', 62" and may comprise cooperating male and female members or vice versa. The radial latching mechanism 30 is attached to one 80 of a pair of sliding doors 80, 82. The doors slide relative to one another as represented by the arrows 84, 86. The guide 62' is attached to the same door 80 as the latching mechanism 30. The guide 62" is attached to the other 82 of the two doors. Safety switch 15 is attached to the same door 82 as the guide 62". FIG. 8 shows the doors 84, 86 in a partially open position. When the doors are brought together the latching mechanism 30 can be moved into position with the guide units 60', 60" engaging with the guide members 62', 62" and with the actuator 32 engaging with the safety switch 15 to allow any machine contained within the enclosure provided with the doors to be started. It follows that to open the doors the latching mechanism has to be raised disengaging the actuator 32 from the safety switch and closing down the machine.

In alternative embodiments (not shown), it is envisaged that the distance between the pivot points on each radial member differ and/or the spacing between corresponding pivot points on the radial members is not equal. By varying the different distances and spacings between the pivot points, it is possible for the actuator holder (and hence the actuator) to be arranged to follow any predetermined arc, and also for the actuator holder/actuator orientation to vary as desired along the path of the arc. Thus, the actuator holder can be arranged to be orientated as desired, to correctly engage the safety switch even if the position of the latching mechanism relative to the safety switch is incorrect.

The invention claimed is:

1. A radial latching mechanism for engaging a safety switch, the radial latching mechanism comprising:

an actuator holder;

an actuator for engaging the safety switch, the actuator being attached to the actuator holder in a predetermined orientation relative to said holder;

a body for supporting the actuator holder;

a first radial member extending between and pivotally connected by respective pivot points to both the body and the actuator holder;

a second radial member extending between and pivotally connected by respective pivot points to both the body and the actuator holder;

wherein each pivot point has a pivot axis, all of said pivot axes being substantially parallel; and wherein the distance between the pivot point connecting the first radial member to the body and the pivot point connecting the second radial member to the body is substantially equal to the distance between the pivot point connecting the first radial member to the actuator holder and the pivot point connecting the second radial member to the actuator holder.

2. A latching mechanism as claimed in claim 1, wherein the distance between the pivot points of the first radial member is substantially equal to the distance between the pivot points of the second radial member.

3. A latching mechanism as claimed in claim 1, wherein both the first radial member and the second radial member are substantially planar, and extend in a common plane substantially perpendicular to said pivot axes.

4. A latching mechanism as claimed in claim 1, wherein the actuator is resiliently biased so as to maintain said predetermined orientation.

5. A latching mechanism as claimed in claim 1, further comprising a guide unit fixedly located on said actuator holder, extending in a substantially parallel direction to said predetermined orientation of the actuator, and arranged to mate with a corresponding guide unit on the safety switch.

6. A latching mechanism as claimed in claim 5, wherein said guide unit is a wedge-shaped member.

7. A radial latching mechanism for engaging a safety switch, the radial latching mechanism comprising:

an actuator holder;

an actuator for engaging the safety switch, the actuator being attached to the actuator holder in a predetermined orientation relative to said holder;

a body for supporting the actuator holder;

a first radial member extending between and pivotally connected by respective pivot points to both the body and the actuator holder;

a second radial member extending between and pivotally connected by respective pivot points to both the body and the actuator holder;

wherein each pivot point has a pivot axis, all of said pivot axes being substantially parallel; and wherein the actuator extends from said actuator holder along a first axis, and is arranged to tilt away from said first axis.

8. A latching mechanism as claimed in claim 7, wherein said first axis extends in an actuator plane substantially perpendicular to said pivot axes, said actuator being arranged to tilt in at least one of said actuator plane and a plane substantially perpendicular to said actuator plane.

9. A latching mechanism as claimed in claim 1, wherein the actuator is arranged to actuate the safety switch upon engaging the safety switch.

10. An enclosure comprising a frame and a door, one of the door and the frame having a safety switch attached thereto, and another of the door and the frame having a radial latching mechanism attached thereto for engaging said safety switch, the radial latching mechanism comprising:

an actuator holder;

an actuator for engaging the safety switch, attached to the actuator holder in a predetermined orientation relative to said holder;

a body for supporting the actuator holder;

a first radial member extending between and pivotally connected by respective pivot points to both the body and the actuator holder;

a second radial member extending between and pivotally connected by respective pivot points to both the body and the actuator holder;

wherein each pivot point has a pivot axis, all of said pivot axes being substantially parallel; and wherein the distance between the pivot point connecting the first radial member to the body and the pivot point connecting the second radial member to the body is substantially equal to the distance between the pivot point connecting the first radial member to the actuator holder and the pivot point connecting the second radial member to the actuator holder.

11. An enclosure as claimed in claim 10, wherein said latching mechanism comprises a first release handle extending outside of the enclosure, and a second release handle extending inside of said enclosure, the release handles being operable to disengage the actuator from the safety switch.

12. An enclosure as claimed in claim 10, wherein the actuator extends from said actuator holder along a first axis, and is arranged to tilt away from said first axis.

13. An enclosure as claimed in claim 10, further comprising a guide unit fixedly located on said actuator holder, extending in a substantially parallel direction to said predetermined orientation of the actuator, and arranged to mate with a corresponding guide unit on the safety switch.

14. A radial latching mechanism for engaging a safety switch, the radial latching mechanism comprising:

an actuator holder;

an actuator supported by the actuator holder and configured to engage the safety switch;

a body for supporting the actuator holder;

a first radial member extending between and pivotally connected by respective pivot points to both the body and the actuator holder; and a second radial member extending between and pivotally connected by respective pivot points to both the body and the actuator holder;

wherein as the first radial member and the second radial member pivot with respect to the body, the actuator holder moves along an arcuate path while substantially maintaining a predetermined orientation with respect to the safety switch; and wherein the distance between the pivot point connecting the first radial member to the body and the pivot point connecting the second radial member to the body is substantially equal to the distance between the pivot point connecting the first radial member to the actuator holder and the pivot point connecting the second radial member to the actuator holder.

15. A latching mechanism as claimed in claim 14, wherein the actuator extends from said actuator holder along a first axis, and is arranged to tilt away from said first axis.

16. A radial latching mechanism for engaging a safety switch, the radial latching mechanism comprising:

an actuator holder;

an actuator supported by the actuator holder and configured to engage the safety switch when in a closed position;

a body for supporting the actuator holder;

a first radial member extending between and pivotally connected by respective pivot points to both the body and the actuator holder; and a second radial member extending between and pivotally connected by respective pivot points to both the body and the actuator holder;

wherein the actuator holder is moveable from the closed position to an open position in which the actuator does not engage the safety switch;

wherein the actuator holder is in substantially similar orientations with respect to the safety switch in the closed position and the open position; and wherein the actuator extends from said actuator holder along a first axis, and is arranged to tilt away from said first axis.

17. A latching mechanism as claimed in claim 16, wherein the distance between the pivot point connecting the first radial member to the body and the pivot point connecting the second radial member to the body is substantially equal to the distance between the pivot point connecting the first radial member to the actuator holder and the pivot point connecting the second radial member to the actuator holder.

* * * * *